United States Patent [19]

Wright

[11] 4,270,108

[45] May 26, 1981

[54] BISTABLE CONTROL SWITCH

[75] Inventor: William W. Wright, Wheaton, Ill.

[73] Assignee: Guardian Electric Manufacturing Company, Chicago, Ill.

[21] Appl. No.: 101,469

[22] Filed: Dec. 10, 1979

[51] Int. Cl.[3] ..... H01H 5/00

[52] U.S. Cl. ..... 335/188; 335/190

[58] Field of Search ..... 335/128, 185, 188, 189, 335/190; 200/153 J

[56] References Cited

U.S. PATENT DOCUMENTS

| | | | |
|---|---|---|---|
| 3,689,858 | 9/1972 | Rosch et al. | 335/188 |
| 3,728,651 | 4/1973 | Foster | 335/190 X |
| 3,748,610 | 7/1973 | Guthart | 335/190 |

FOREIGN PATENT DOCUMENTS

| | | | |
|---|---|---|---|
| 2148820 | 4/1973 | Fed. Rep. of Germany | 335/190 |

*Primary Examiner*—George Harris

*Attorney, Agent, or Firm*—Allegretti, Newitt, Witcoff & McAndrews

[57] ABSTRACT

An improved two position control switch includes a spring biased pivoting armature with a projecting cantilever spring wire. The spring wire can be flexed in a direction transverse to the pivoting movement of the armature. The spring wire flexes to cooperate with a cam track thereby retaining the armature in one of two stable positions. Switching between positions occurs in response to pulse signals to the armature coil.

8 Claims, 8 Drawing Figures

BISTABLE CONTROL SWITCH

BACKGROUND OF THE INVENTION

In a principal aspect, the present invention relates to an improved switch and more particularly to a switch wherein switch contacts are retained in one of two contact positions upon momentary actuation of the switch coil.

In order to prevent overloading of electrical generation and distribution systems during peak loading times, it has been suggested that mechanisms be devised which will automatically eliminate or disconnect selected portions of the load. For example, it may be possible to disconnect all electric water heaters or air conditioners during a peak electrical demand in order to avoid overloading of the distribution system and electric generation equipment.

Heretofore, however, there has been no simple way for terminating such a load and selectively reducing residential electric demand. As a result, large electrical users, such as industrial users, are often required to cut back on their electrical usage during peak demand times. Such cut backs may have severe economic consequences.

Thus, it has been proposed to provide a mechanism which is responsive to a momentary and very small electrical signal which will on demand disconnect and reconnect residential electrical appliances, for example, water heaters or air conditioners, during peak load demand times. Such a controller could, for example, be operated by electrical signals transmitted through telephone lines or by a signal carried through the electrical transmission lines, radio control, etc. For such a system to be operative, however, it is desirable to provide a relay or switch which will respond to a momentary signal to make and/or break a contact. Such a relay should have the capability of maintaining its last energized state even though the energization signal is subsequently withdrawn. In terms of logic, such a device is known as a flip-flop switch. The present invention constitutes a switch responsive to a small signal to make or break a circuit even though the control signal is momentary, and to provide circuit information as to the state of the circuit, i.e., whether the circuit is in the "on" or "off" condition.

In this particular case, energy storage is provided so that the device may be actuated even in the event of a power line failure for periods of five (5) minutes or more after the main power is terminated. The closure of a mechanical or electronic switch operated upon demand from the power generating station can cause the actuation of the device. Such an operation can be automatic or selective or programmed depending upon condition.

In one version, power storage is provided to permit shut off of the non-essential household appliances after electrical power loss, thus permitting operation of the unit for periods of up to several minutes after the power line failure.

A part of the device, although not a necessary part, is the incorporation of one or more sensors which permit feedback of the controller status to the power control station. These sensor devices can provide current consumption details in the controlled line, for example, as to whether the circuit is open or closed and/or whether the controlled device is on or off and/or essentially how much current the controlled circuit is drawing at the point in time of an inquiry.

SUMMARY OF THE INVENTION

Briefly the present invention comprises a relay or switch which includes a pivotally mounted armature actuated when current passes through an associated coil. The armature operates to make or break a circuit by driving contacts. A signal pulse to the relay coil is effective to move the armature between its two stable positions. The armature is retained in each position by cooperative action of a flexible, cantilever member attached to the armature and a special cam track member. Thus, upon actuation of the armature in response to passage of current through the coil of the relay, the armature will move between a first released position and a second locked position. The relay is maintained in the locked position until a second discreet signal actuates movement of the armature from the locked to the released position. In this manner the relay may continuously cycle between locked and released positions.

Momentary actuation of the relay by a low power signal or switch closure may operate to make or break a circuit to an appliance associated with the relay. For example, a telephone signal to the relay may cause the relay, which is installed to control a water heater, to terminate power to the water heater. This telephone signal may be generated by a programmed control mechanism. In this manner, loads within a certain geographical region can be automatically reduced during peak demand times or when generating equipment is overloaded for whatever reason.

Thus it is an object of the present invention to provide an improved two position bistable switch or relay.

It is a further object of the present invention to provide a two position switch which includes an armature operative in response to low power input and which maintains a fixed relay position following a discreet control signal.

It is a further object of the present invention to provide an inexpensive and reliable switch which may be used for controlling various electrical devices.

It is a further object of the present invention to provide sensor which can feed back circuit data to the generating control station.

These and other objects, advantages and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENT

Figure 1:
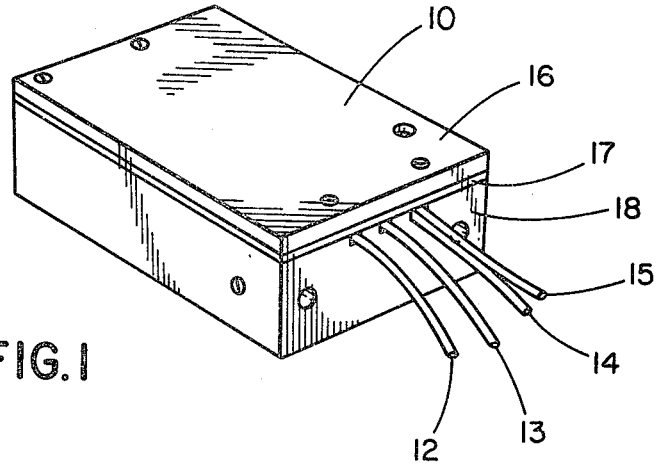
FIG. 1 is a perspective view of the improved relay of the present invention as incorporated with a component package adapted for use in combination with an appliance such as a water heater.
Figure 8:
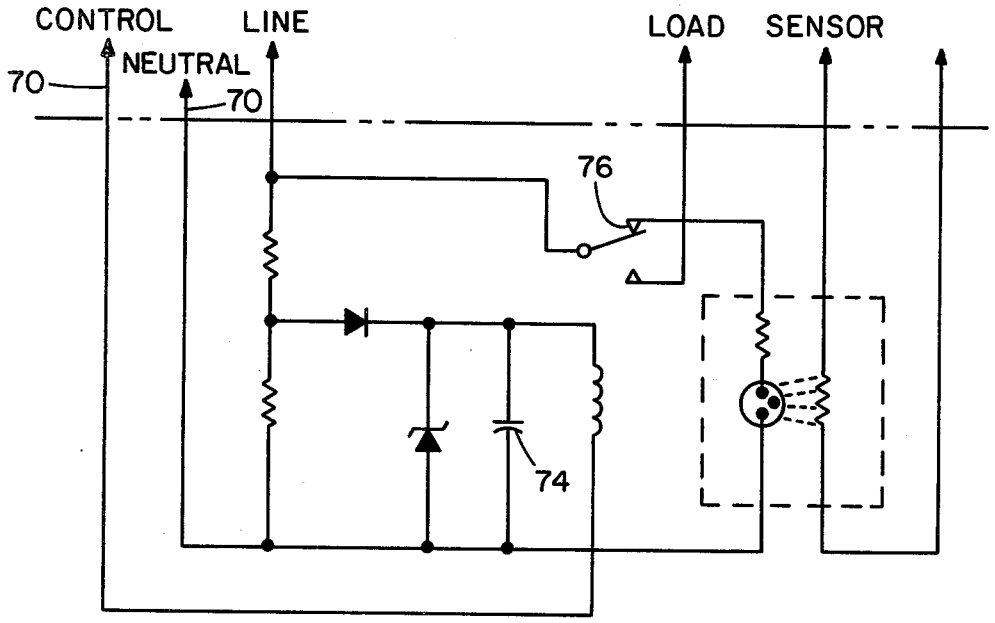
FIG. 8 is an electrical schematic for the package shown in FIG. 1.

As shown in FIG. 1, the improved relay or switch of the present invention is incorporated in a component package 10 having lead wires 12–15 connected to the electrical components retained within the package. FIG. 8 illustrates a typical circuit diagram for the package.

Figure 2:
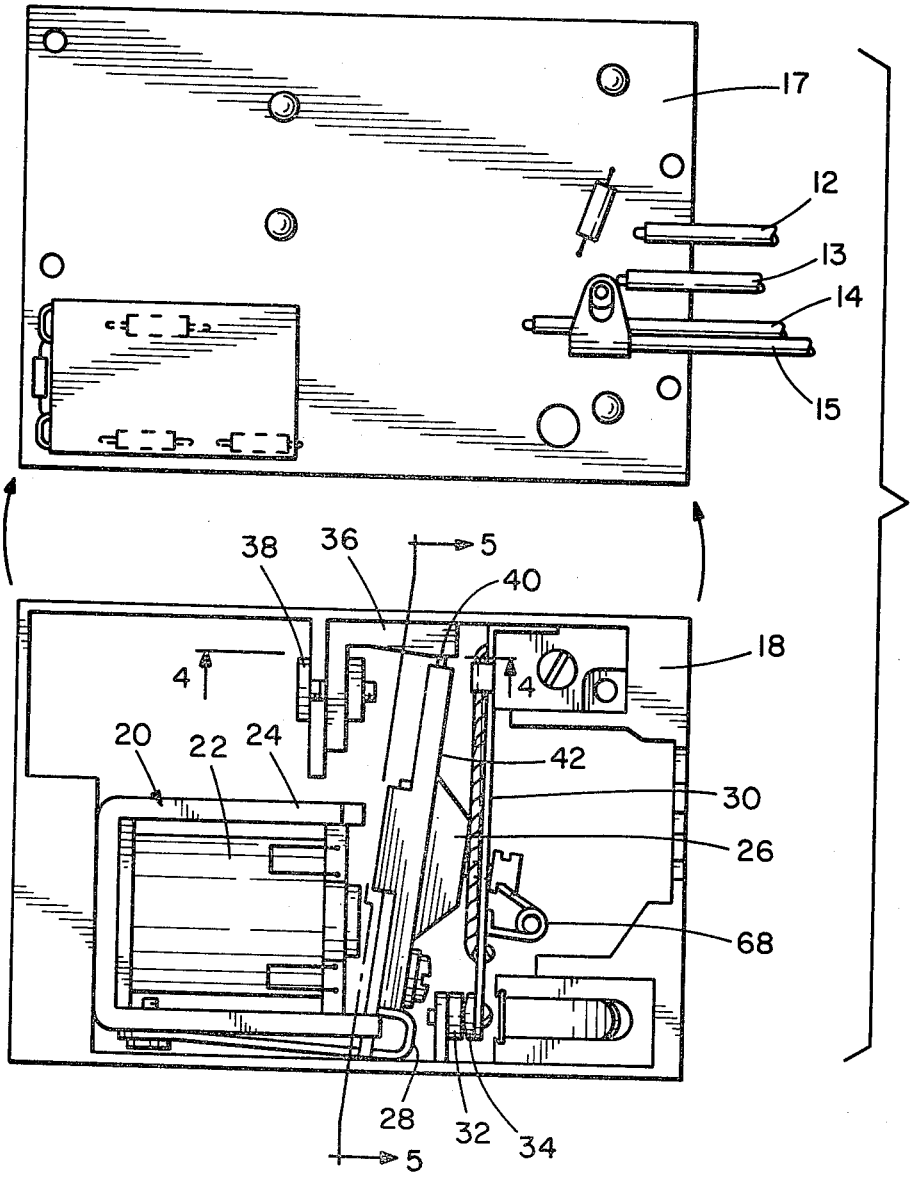
FIG. 2 is a plan view of the package of FIG. 1.

Referring to FIG. 2, the package 10 includes a lid 16 and a circuitboard 17, the underside of which is illustrated in FIG. 2, and a container 18 which receives the electrical components comprising the package 10. Thus, the container 18 includes a relay or switch 20 having a coil 22 mounted on a field piece 24. An armature 26 is pivotally attached to the field piece 24 by a spring 28. The armature 26 is mounted to engage with contact blade 30 and thereby cause engagement or disengagement of contacts 32, 34.

A cam trackway mechanism 36 is attached to the housing 18 by means of a fastener 38. The cam trackway mechanism 36 cooperates with a flexible wire 40, as described in greater detail below, to provide the sequential operation of the switch 20.

Figure 3:
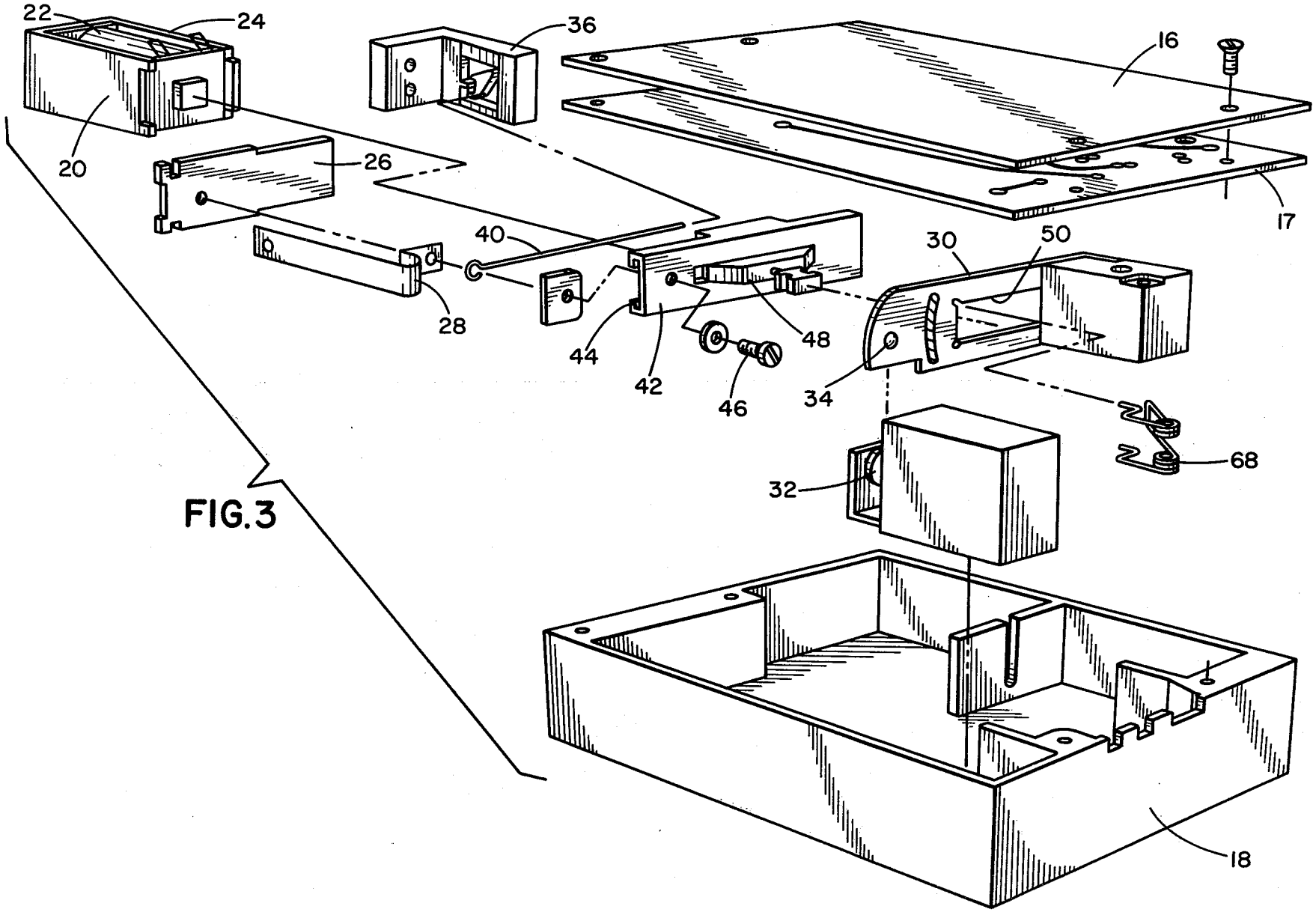
FIG. 3 is an exploded perspective view of the component parts of the package of FIG. 1 including the relay.
Figure 4:
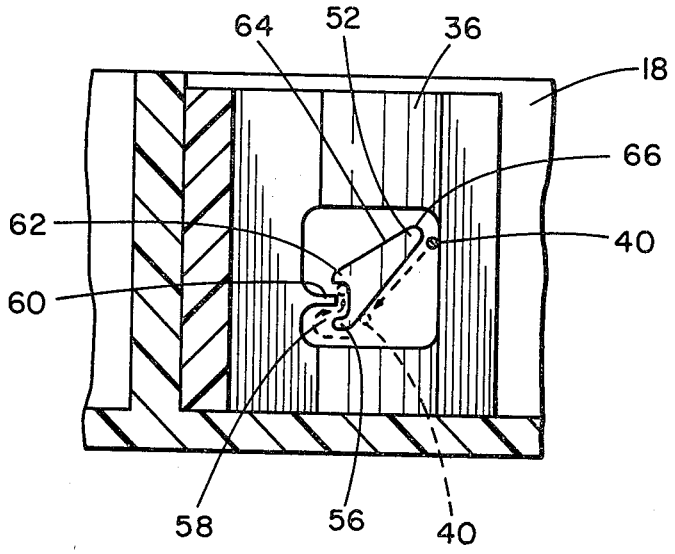
FIG. 4 is a partial cross sectional view of the improved relay position control mechanism associated with the relay of the present invention taken substantially along the line 4—4 in FIG. 2.
Figure 5:
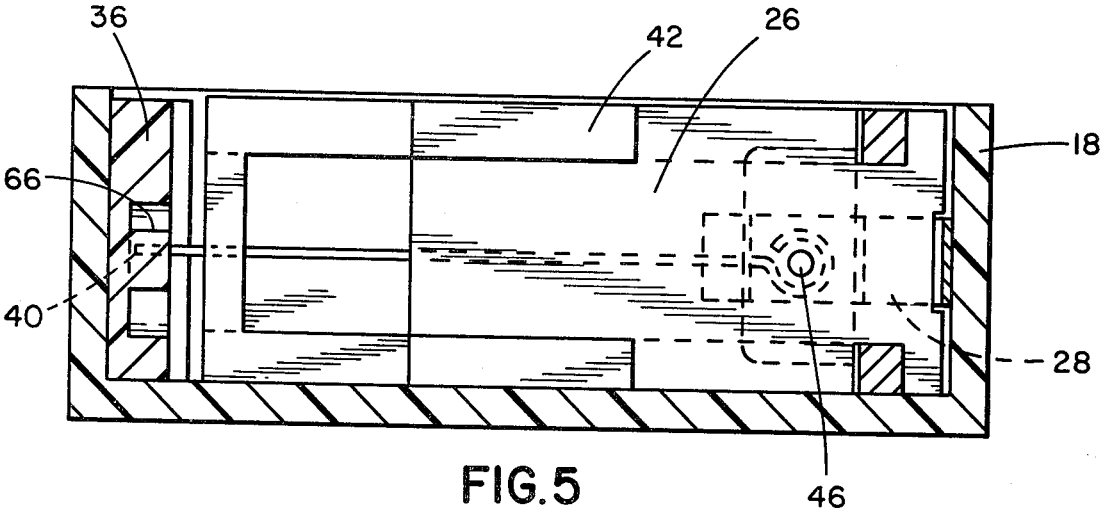
FIG. 5 is a cross sectional view taken along the line 5—5 in FIG. 2.
Figure 6:
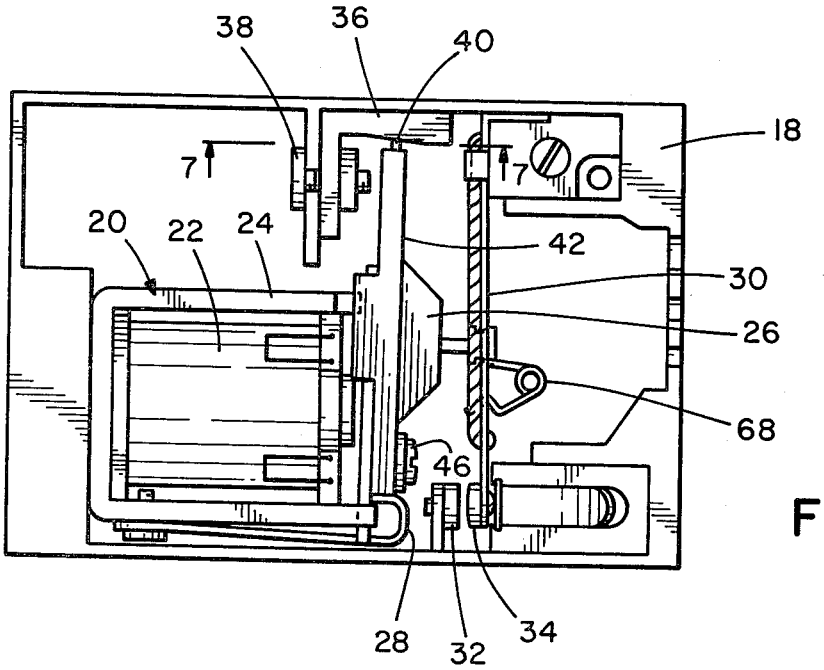
FIG. 6 is a plan view of the relay as incorporated in the package wherein the relay has been moved to a second switch position.

FIGS. 3–7 illustrate in greater detail the construction of the positioning mechanism for the switch 20. Referring particularly to FIGS. 3–5, the armature 26 is pivotally attached to the top of field piece 24 by means of the spring 28. A plastic blade drive member 42 slidably receives the flat, plate armature 26 in a slot 44 of the drive member 42. A cantilever wire 40 projects along the longitudinal axis of the armature 26 and is retained between the sides of the slot 44. The wire 40, drive member 42 and armature 26 are held together by means of a fastener 46 which connects these parts to the spring 28.

The drive member 42 includes a connecting tab 48 which fits through a slot 50 of blade 30 and serves to drive the contact blade 30. Movement of the blade 30 is effected by movement of armature 26 which, in turn, moves in response to passage of current through coil 22.

The end of spring 40 cooperates with cam trackway 36 to position and retain the armature 26 in one of two positions. More specifically referring to FIG. 4, the wire 40 is shown at its neutral or rest position when the armature coil 22 is de-energized and the armature 26 is spring biased to its outermost position by spring 28. That is, through the wire 40 can be biased in a plane transverse to the direction of armature movement, the wire 40 is unbiased as shown in FIG. 4 and thereby defines a neutral position.

Upon actuation of the armature 26, the wire 40 will be transported to the left in FIG. 4. As it is translated it engages a cam block 52 of trackway 36 and more particularly engages the surface 54 of cam block 52. Surface 54 defines a first track which is inclined from a position on one side of the neutral position to the other side as shown in FIG. 4. Thus, the wire 40 will be biased on a plane transverse to the plane of the armature 26 as the armature 26 moves toward the left in FIG. 4. The wire ultimately passes over a projection 56 as the armature 26 transports the wire further and further to the left. The wire 40 then snaps against the wall 60 and is retained against the wall 60 so long as current in coil 20 maintains the armature 26 in the lowest position as illustrated in the FIGURES.

Termination of current in coil 22 causes the armature 26 to likewise be released. The wire 40 then slips into a notch 58 as shown in FIG. 4. This slippage occurs because the wire 40 is carried by armature 26 as armature 26 is biased by spring 28. The spring 40, once in notch 58, then rides over the wall 60. The wall 60 prevents the wire 40 from initially returning laterally to a neutral position. Thus, the wire 40 is positioned in the notch 58 where it is retained upon release of current through coil 22. The wire 40 remains retained within the notch 58 by lip 62.

Figure 7:
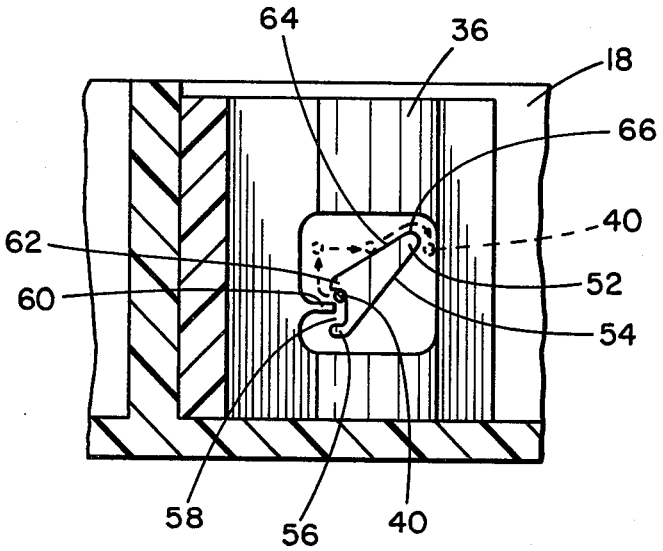
FIG. 7 is a cross sectional view of the relay of FIG. 6 taken substantially along the line 6—6.

A subsequent actuation of the armature 26 by coil 22 is required to draw the armature 26 down and thereby release the wire 40 from the lip 62. Upon such a second actuation of the armature 26, the wire 40 will move along the lip 62 and springs toward a neutral position as shown by FIG. 7. Then, upon release of current from the coil 22, the armature 26 will, by action spring 28, return toward its released position. This causes the wire 40 to be transported against a second cam track surface 64 and to rise over the end projection 66 to the original neutral position as shown in FIG. 4.

In this manner, a first current pulse through coil 22 will transport the armature to the position of FIG. 7. A second pulse will transport the armature to the position illustrated by FIG. 4. Such transport of the armature 26 will make and break the circuit associated with contacts 32 and 34.

That is, the contact blade 50 includes an overcenter acting spring mechanism 68 to facilitate switch action for the contacts 30 and 32. A pulse in coil 22 will cause switching action through the pulse need only be a very short duration. In this manner the pulse can operate to make or break a contact connection and retain the circuit in the state into which it was most recently switched. Control of the relay remotely may be effected by utilization of a circuit diagram as illustrated in FIG. 8.

Referring to FIG. 8, a momentary closure of the switch between control line 70 and the neutral line 72 discharges the capacitor 74 through the coil closing contacts 76 which extend between line and load. The contacts remain closed until the armature 26 is again actuated by a pulse signal to move to the latched position of FIG. 7. The coil 22 need not remain activated to maintain the armature in its position since the mechanical latching mechanism previously described maintains the armature.

Various other circuits and arrangements of the relay of the present invention may be utilized in combination with the relay or switch. For example, a plurality of camming surfaces could be provided to thereby permit multiple, sequential operation of the armature and contacts. Thus, the invention is to be limited only by the following claims and their equivalents.

What is claimed is:

1. In a bistable position switch comprising a coil with a field piece, an armature pivotally connected to the field piece and responsive to current passing through the coil, the improvement of an armature holding end release mechanism for effectively maintaining the armature in a first coil actuated position upon termination of current through the coil and in a second release position upon subsequent actuation of the armature by the coil followed by release thereof, said improvement comprising in combination:

(a) a cantilever member projecting from the armature, said member being flexible in a plane generally transverse to the direction of armature movement;

(b) a cam guide member fixed with respect to the cantilever member, said cam guide member being cooperative with the cantilever member and including a (i) first track for guiding the cantilever member to a notch holding position, and (ii) a second track for guiding the cantilever member from the notch holding position to a release position.

2. The improved relay of claim 1 wherein the cantilever member defines a neutral unflexed position in the transverse direction and wherein the cam guide member defines first and second cam tracks generally in a plane perpendicular to the cantilever member, the first track extending from one side of the neutral position to the opposite side and inclined in the direction of cantilever movement due to coil actuation, said first track terminating prior to maximum coil actuated travel of the cantilever member to thereby permit lateral movement of the cantilever member toward the transverse neutral position, whereby actuation of the coil causes the cantilever member to follow the first track to a locking notch which retains the cantilever member upon termination of current to the coil.

3. The improved relay of claim 2 wherein the second track is on the opposite side of the neutral position of the cantilever member and is inclined in the same direction as the first track, said second track terminating short of the maximum limit of cantilever member travel in response to movement of the armature whereby the cantilever member may follow the second track upon release from the notch by coil actuation and subsequent coil deactivation to a neutral position.

4. The improved relay of claim 1 wherein the cantilever member extends longitudinally from the armature and wherein said armature moves in a first arc to simultaneously carry the cantilever member while the cantilever member is mounted to simultaneously move in a direction by flexing transverse to the arc.

5. The improved relay of claim 1 wherein said cantilever is a spring wire projecting from the armature.

6. The improved relay of claim 1 wherein said cantilever comprises a spring wire projecting from the armature and said cam member is a trackway cooperative with said wire to retain the wire in a neutral position when the coil is deactivated and the armature is in a release position and to maintain the cantilever member in a non-neutral notch position when the armature has been subsequently activated and released.

7. In a bistable position switch comprising a coil mounted on a field piece, an armature movable with respect to the field piece and responsive to current passing through the coil, the improvement of an armature holding and release mechanism for effectively maintaining the armature in a first coil actuated position upon termination of current through the coil and in a second release position upon subsequent actuation of the armature by the coil followed by release thereof, said improvement comprising in combination:

(a) a cantilever member projecting from the armature, said member being flexible in a plane generally transverse to the direction of armature movement;

(b) a cam guide member fixed with respect to the cantilever member, said cam guide member being cooperative with the cantilever member and including a (i) first track for guiding the cantilever member to a notch holding position, and (ii) a second track for guiding the cantilever member from the notch holding position to a release position.

8. A bistable position switch comprising, in combination:

a coil;

a frame for mounting the coil;

a switch member mounted for reciprocal movement with respect to the coil between a first switch position and a second switch position, said switch member being movable in response to a current pulse in the coil; and means for maintaining the switch member in one of said positions subsequent to a current pulse in said coil, said means for maintaining including (a) a flexible cantilever member projecting from the switch member;

(b) a cam guide member fixed to the frame and fixed with respect to the cantilevered member, said cantilever member and said cam guide member including cooperating cam and follower elements comprising (i) a first track for guiding the cantilever member to a notch holding position, and (ii) a second track for guiding the cantilever member from the notch holding position to a release position, said notch holding and release positions defining respectively the first and second positions of the switch member.

* * * * *